US007112247B2

(12) United States Patent
Stelcher et al.

(10) Patent No.: US 7,112,247 B2
(45) Date of Patent: Sep. 26, 2006

(54) CANNED GAS DUST REMOVER WITH AIR IONIZER

(75) Inventors: William Stelcher, Sarasota, FL (US); Michael J. Beane, Bradenton, FL (US)

(73) Assignee: Kinetronics Corporation, Sarasota, FL (US)

( * ) Notice: Subject to any disclaimer, the term of this patent is extended or adjusted under 35 U.S.C. 154(b) by 559 days.

(21) Appl. No.: 10/328,647

(22) Filed: Dec. 23, 2002

(65) Prior Publication Data

US 2004/0118428 A1 Jun. 24, 2004

(51) Int. Cl.

| | |
|---|---|
| ***B08B 5/00*** | (2006.01) |
| ***B08B 6/00*** | (2006.01) |
| ***B08B 7/04*** | (2006.01) |

(52) U.S. Cl. ..... 134/1; 134/37; 134/42; 15/1.51; 15/1.52; 15/300.1; 15/405

(58) Field of Classification Search ..... 134/1, 134/1.1, 37, 42; 15/405, 1.51, 1.52, 300.1
See application file for complete search history.

(56) References Cited

U.S. PATENT DOCUMENTS

| | | | | |
|---|---|---|---|---|
| 4,364,147 | A * | 12/1982 | Biedermann et al. | 15/404 |
| 4,978,371 | A * | 12/1990 | Smyrloglou | 96/10 |
| 5,187,635 | A * | 2/1993 | Yehl | 361/231 |

OTHER PUBLICATIONS

Brochure "Static Vac™" Product of Kinetronics Corporation, 2000.

* cited by examiner

*Primary Examiner*—Alexander Markoff
(74) *Attorney, Agent, or Firm*—Schiff Hardin LLP

(57) ABSTRACT

In a method and system for removing particles from a surface, a portable, compressed gas can is provided containing a particle removal gas. An air ionizer unit is connected to the gas can. A high voltage potential is selectively actuated at a time when a nozzle of the gas can is depressed, the high voltage potential being positioned in the gas stream to create air ions in the gas stream which facilitate removal of the particles.

13 Claims, 4 Drawing Sheets

FIG. 6
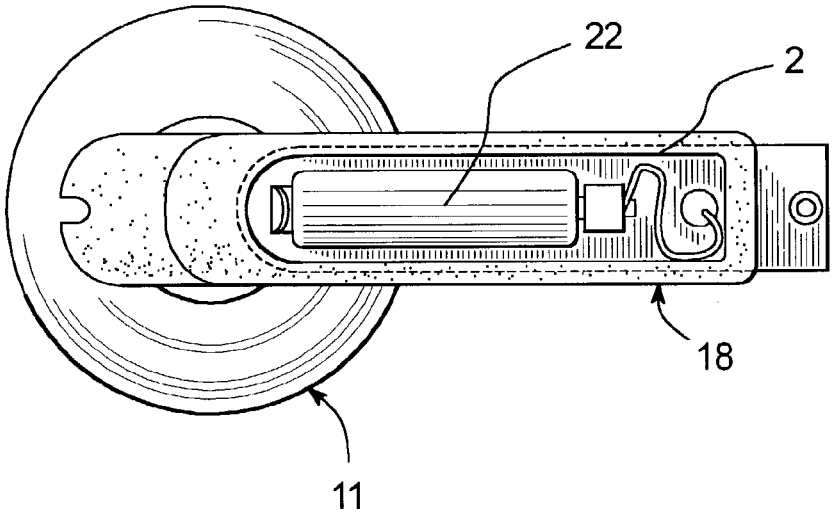
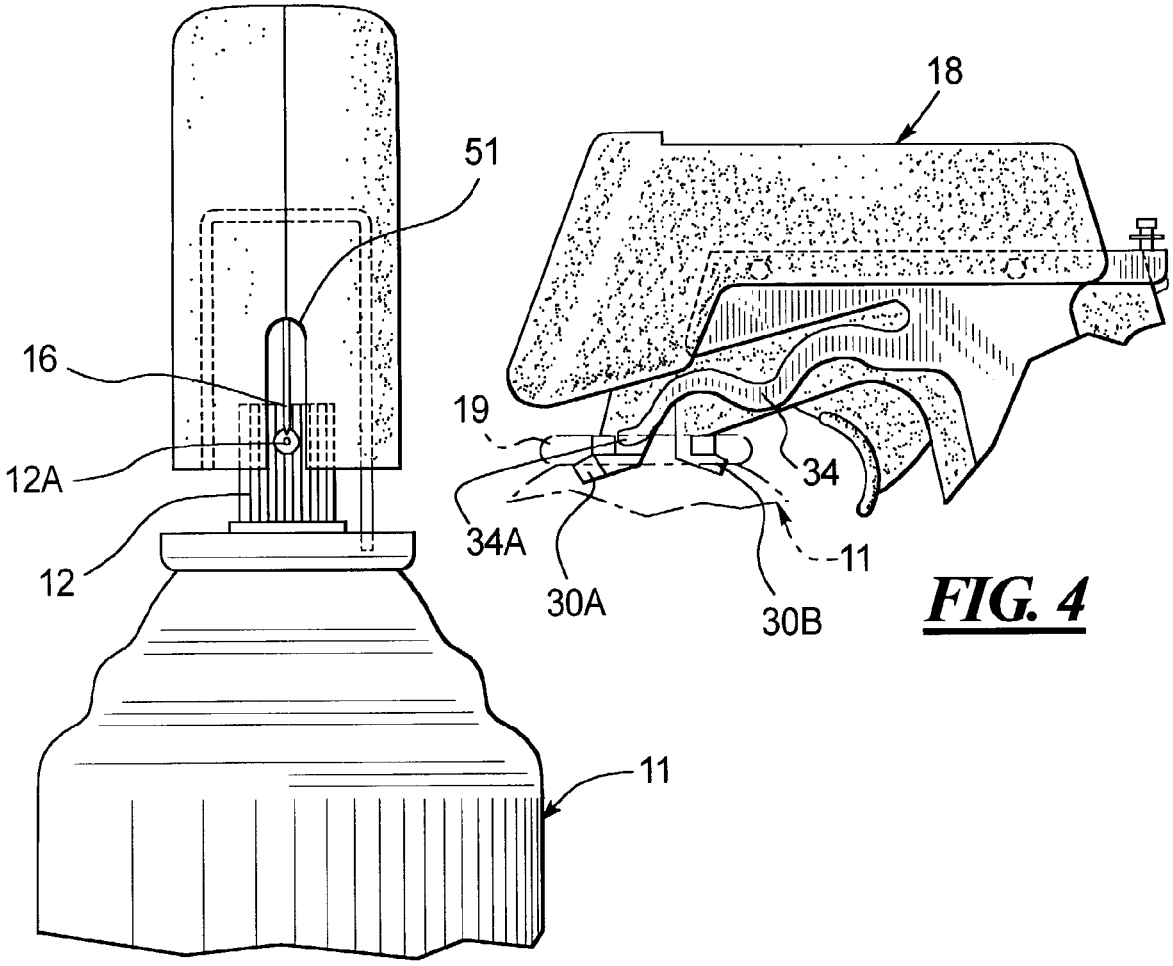
FIG. 4
FIG. 5

23
42
42A
42B
50
24
41
40
38
39
37
7A
7B
7
22
16
9
47
43
44
45
46

CANNED GAS DUST REMOVER WITH AIR IONIZER

BACKGROUND OF THE INVENTION

Canned gas dust removers are known which utilize a can of compressed gas. When a nozzle on the top of the can is depressed or otherwise activated, compressed gas within the can is released through a nozzle aperture of the nozzle to create a jet stream of gas which impacts upon particles to be removed such as dust, dirt, lint, or the like. Such prior art compressed gas canned dust remover products are useful for cleaning computers, photographic equipment, keyboards, lenses, films, office equipment, and the like.

When these dusters are used, the ability of the gas jet to remove the particles is reduced by what is called the triboelectric effect. This effect produces an electric charge when two dissimilar materials are brought in contact, and is often observed with artificial fabrics as "static cling".

For example, in the case of using a compressed-gas duster to clean film, the gas jet and the film produce a charge when they come in contact. This charge creates a considerable attractive force to dust particles and either prevents the gas stream from removing the dust, or simply attracts additional dust.

SUMMARY OF THE INVENTION

It is an object of the invention to improve upon prior art canned dust removal products to further enhance their ability to remove particles such as dust, dirt, lint or the like.

According to the present invention, a canned gas particle removal system employs a can containing a compressed gas for particle removal. An ionizer unit is connected to the can and an electrode which is positioned at a nozzle of the can has a high voltage thereon, sufficient to create ions in a gas stream exiting from the nozzle, the gas stream being sufficient to remove particles from a surface desired to be cleaned.

The following drawings are provided to show a preferred embodiment of the invention, but the invention is not limited thereto.

BRIEF DESCRIPTION OF THE DRAWINGS

FIG. 4 is a detailed view showing attachment of the air ionizer to the compressed-gas duster can;

FIG. 5 is a fragmentary front view showing details of the gas outlet nozzle and high voltage tip electrode positioned thereat;

FIG. 6 is a top view showing a battery compartment and an opening into the battery compartment.

DESCRIPTION OF THE PREFERRED EMBODIMENTS

Figure 1:
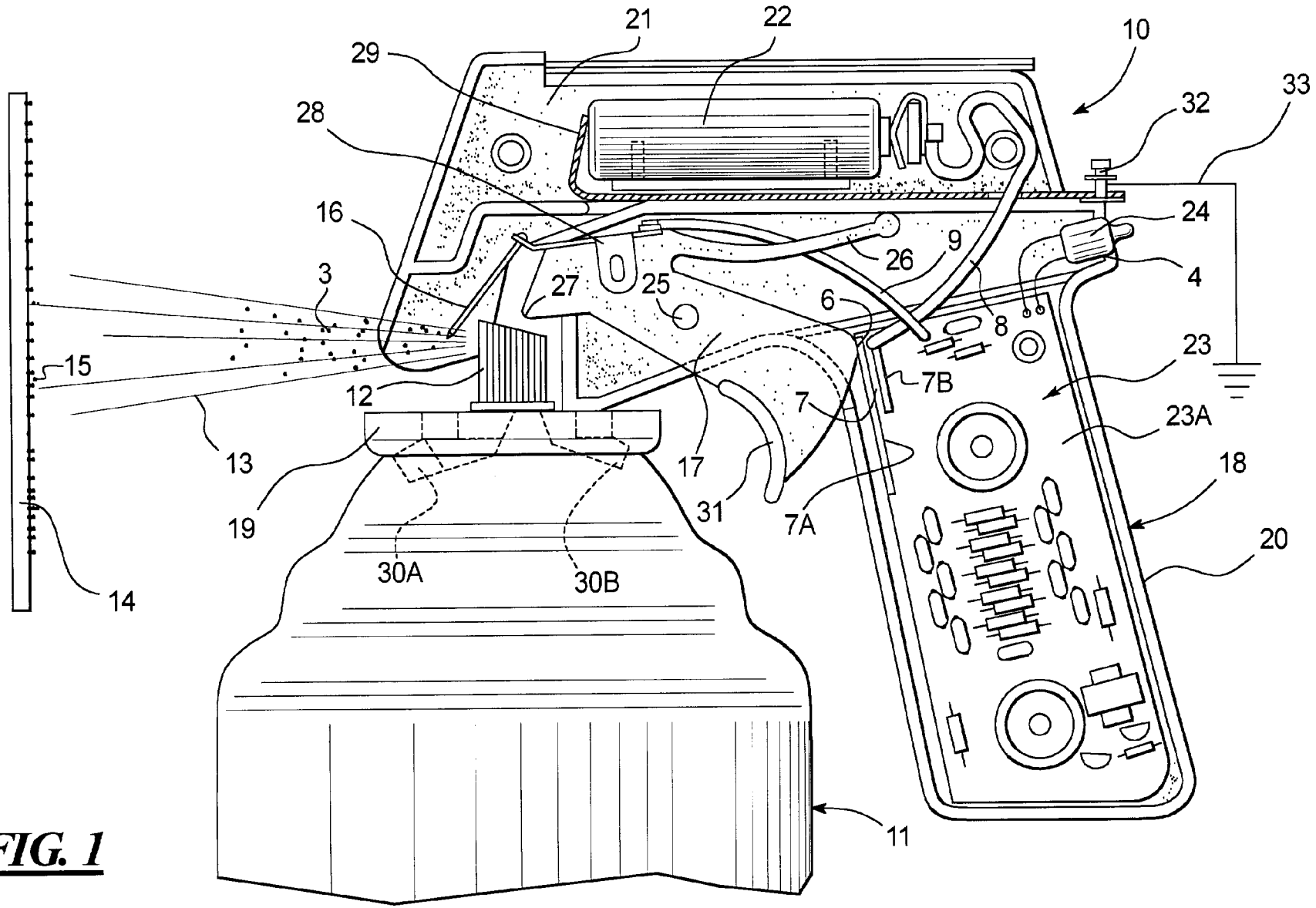
FIG. 1 is a side view of a canned gas dust remover with ionizer wherein a side of the air ionizer is not shown for ease of viewing.

For the purposes of promoting an understanding of the principles of the invention, reference will now be made to a preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In the preferred embodiment and best mode shown in FIG. 1, a canned dust remover with air ionizer is generally shown at 10. A compressed-gas duster can 11 such as known in the prior art is provided. Any such duster now commercially available can be used, provided it does not contain volatile components that could be ignited by the high-voltage tip electrode described hereafter. An air ionizer unit 18 is retained at the top of the can as described hereafter by use of mounting tongs 30A, B received in an annular depression 19 (see FIG. 4).

The can 11 has a push nozzle 12 with a nozzle opening 12*a* (FIG. 5) from which is emitted a gas jet 13 having ions 3 added thereto. The gas jet 13 strikes a surface 14 to be cleaned, which has small particles 15 such as dust, dirt, lint or the like adhering thereto. The force of the jet causes removal of the particles 15. Since ions are added as a result of the presence of a high voltage at a tip electrode 16 positioned closely adjacent the nozzle opening in the gas stream, particle removal is enhanced. The ions are preferably charged air atoms that are attracted to charges on the surface to which the gas jet is directed. The ions are drawn to the surface charge and neutralize the charge when they touch the surface. This leaves the surface neutral with no charge to attract the particles, allowing the force of the gas jet to more effectively remove the particles.

The net result is that particle removal is quicker and more complete. Effective cleaning can be accomplished with shorter bursts of the duster, resulting in an increased useful life of each can.

The air ionizer unit 18 as shown in FIG. 1 has a handle 20 receiving therein a high voltage power supply comprising an inverter circuit 23 powered by a battery 22. The inverter circuit is constructed on a circuit board 23*a* mounted within the handle 20.

A neon indicator light 24 is provided protruding through an aperture 4 at the top of the handle 20. When trigger 17 is depressed at finger grip 31, the neon indicator illuminates, indicating presence of high voltage at the tip electrode 16.

The trigger 17 pivots on a pivot pin 25. When finger grip 31 is pulled back, depression surface in the form of a protrusion 27 strikes the top surface of the nozzle 12, thus depressing it to cause an exit of the gas stream 13. As described previously, this gas stream 13 contains ionized air as a result of the presence of the high voltage at tip electrode 16. These air ions are illustrated at 3, for example.

The trigger 17 includes a biasing member 26 causing projection 6 to be in its left most position when the finger grip 31 is not pulled back. When finger grip 31 is engaged, then a switch 7 is closed as contact areas 7A and 7B touch each other to connect the battery power 22 to the inverter circuit 23 to cause the high voltage at tip electrode 16 to appear.

Typically the high voltage at the tip electrode is in a range of −4 to −5 kilovolts. The battery typically is a 1.5 volt battery.

A mounting bracket 28 secures the tip electrode 16 to the trigger 17 and positions the tip electrode 16 in the gas jet when the trigger is activated so that the tip is in close proximity to the opening of the nozzle.

A high voltage lead 9 conveys high voltage from the inverter 23 to the tip electrode 16.

A battery lead 8 connects the battery 22 to the inverter circuit 23.

The battery 22 is retained in a battery holder 29 within a battery compartment 21. As shown in FIG. 6, the battery compartment has a battery insertion and removal opening 2 at the top thereof.

Extended use or high duty cycles will result in a charge being developed on the user, unless the can or user is grounded. This is not a problem for occasional use, one or two seconds every minute or longer, but will reduce effectiveness and/or produce an effect similar to walking on a rug in dry air after ten or more seconds of continuous use, unless the can or operator is grounded.

To prevent this unwanted charge build up, it is thus desirable in some instances to provide a ground cable 33 such as a ten foot coiled wire or the like having a clip at the end which connects to clip pin 32. The ground cable may be connected to any convenient ground source such as the screw on an electrical outlet cover for example.

Figure 2:
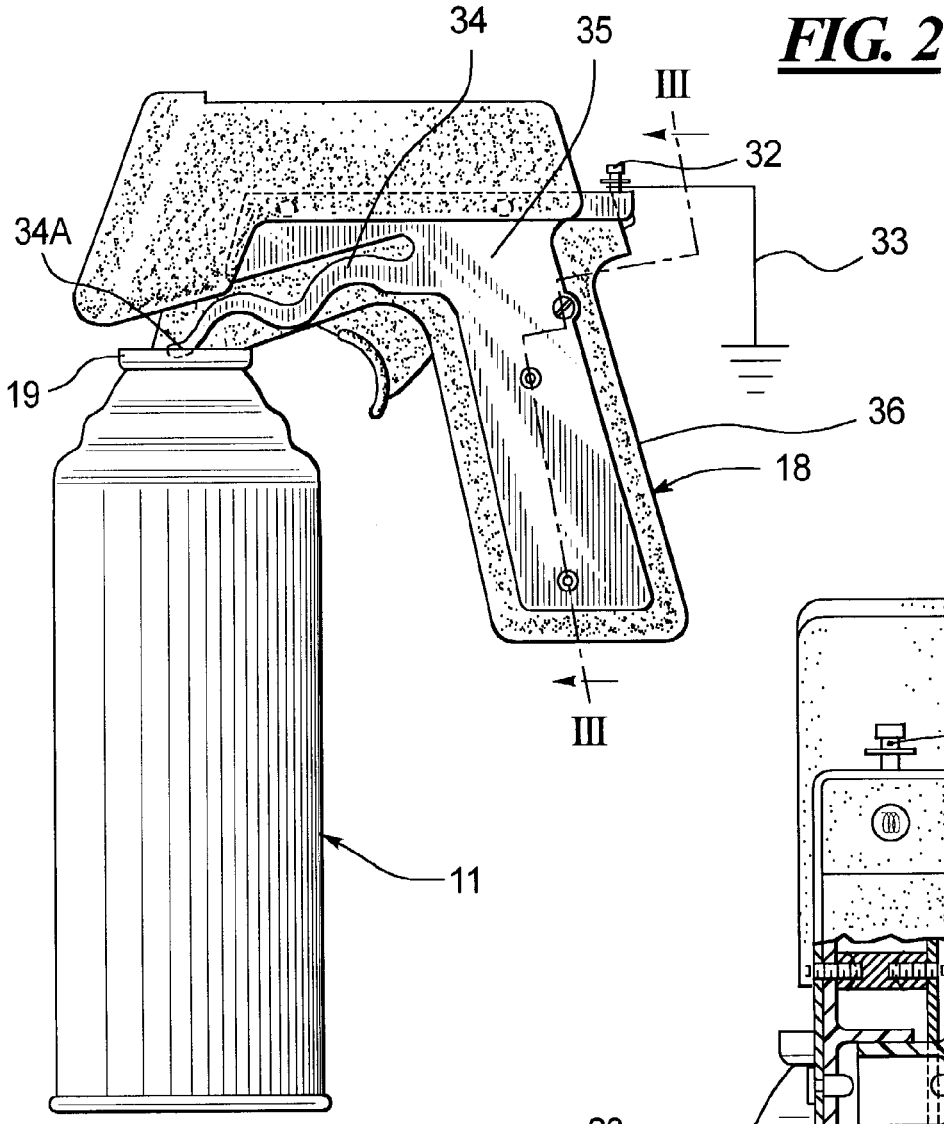
FIG. 2 is a side view of the dust remover with ionizer of FIG. 1, but without the side removed.
Figure 3:
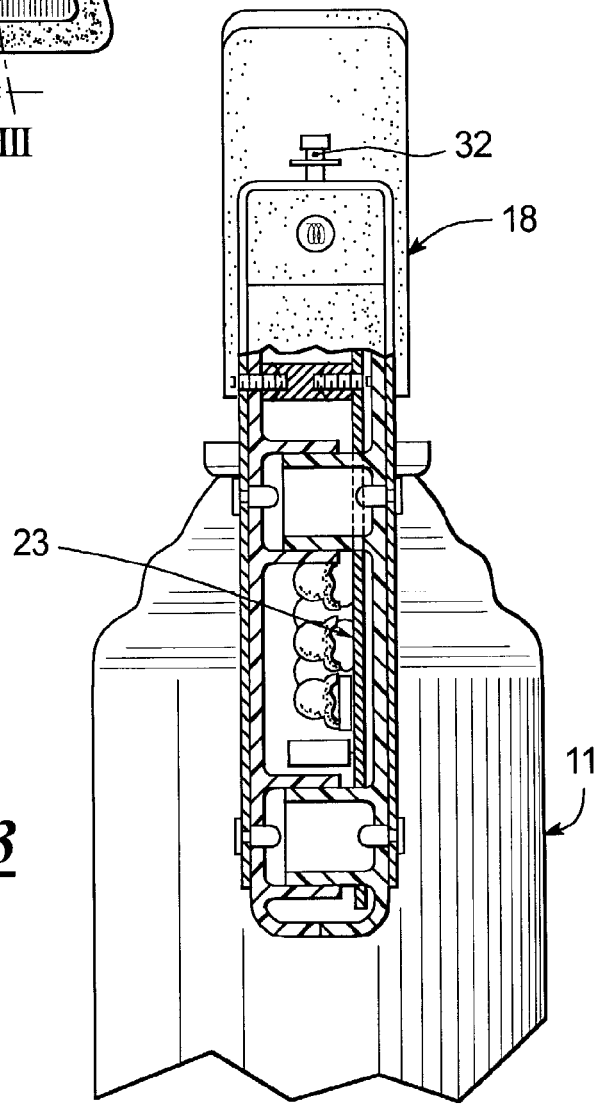
FIG. 3 is a cutaway view along line III—III of FIG. 2.

FIG. 2 shows a metallic strip 34 for electrical engagement with can 11. Thus when the holder is holding the handle 20, both the air ionizer and the can 11 are electrically connected to each other. Tip 34A may contact in the annular depression 19 previously described.

As shown most clearly in FIG. 2, an outer metal shell 35 is provided which receives a plastic insert 36 as a housing.

FIG. 4 shows details of the electrical contact via strip 34 to the can 11 and also shows latching of the ionizer unit 18 via tongs 30A, B to the can 11.

FIG. 5 shows a front view detail of a slot 51 centered on nozzle opening 12*a* of nozzle 12.

FIG. 6 shows a top view of the battery compartment with the battery opening 2.

Figure 7:
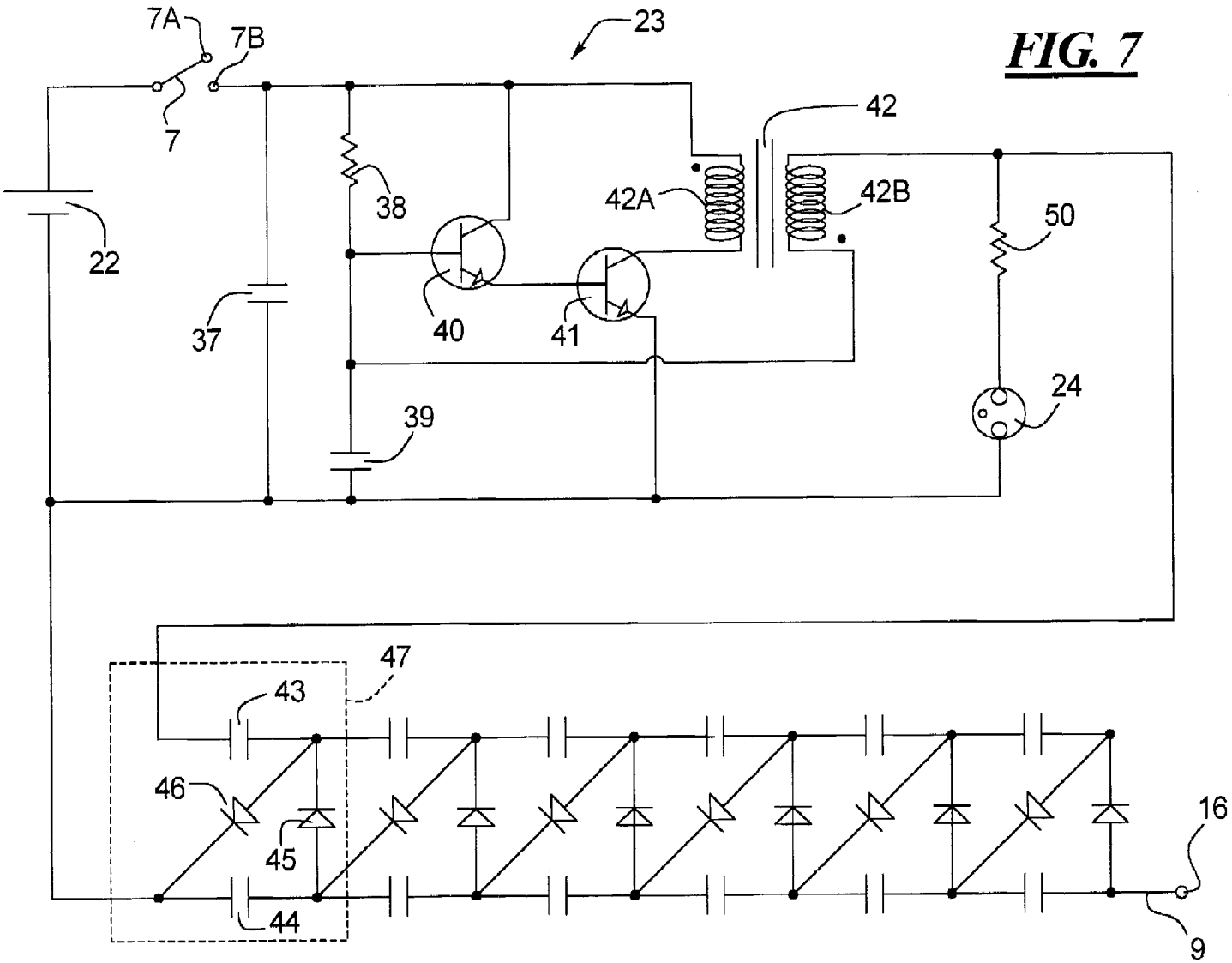
FIG. 7 is a schematic diagram of a high voltage inverter circuit employed for ionizing the air.

FIG. 7 is a schematic wiring diagram of a best mode and preferred embodiment of the high voltage inverter circuit. Battery 22 connects through switch 7 to a two-transistor oscillator circuit connecting to a step-up transformer 42. The circuit includes transistors 40, 41, capacitors 37, 39, and resistor 38. Transistor 41 connects at the primary side 42A of step-up transformer 42. Secondary side 42B has high voltage thereat. The neon bulb 24 connects to the secondary side via resistor 50.

The high voltage secondary 42B is rectified by a series of rectifier elements 47 formed of capacitors 43, 44 and diodes 45, 46. Rectified high voltage output on lead 9 is thus connected to the tip electrode 16.

With the air ionizer described, the high voltage potential causes air molecules in the vicinity of the emitter to acquire a negative charge to produce negative ions. These ions are propelled with the emitted gas where they will be attracted to positive charges on any surface they are directed at, causing the charge to be neutralized. Since static surface charge is one of the primary causes of dust particle attraction and adhesion, the neutralization of the charge enhances the completeness and longevity of dust removal from the target surface.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A canned gas particle removal system, comprising:

a can containing a compressed gas for particle removal;

an ionizer unit connected by a releasable coupling to mount the ionizer unit on the can and an electrode which is positionable at a nozzle of the can and a gas stream exiting from the nozzle and having a high voltage thereon sufficient to create ions in the gas stream exiting from the nozzle, said gas stream being sufficient to remove particles from the surface desired to be cleaned; and the ionizer unit having a moveable trigger which contacts the nozzle and also is connected to the high voltage electrode so that as the trigger moves it depresses the nozzle on the can and moves the electrode into the gas stream.

2. The system according to claim 1 wherein the ionizer unit has a battery powering a high voltage power supply connected to the electrode.

3. The system according to claim 1 wherein the electrode positioned in front of the nozzle of the can has a high voltage thereon of −4 to −5 kilovolts when the gas stream is emitted.

4. The system according to claim 1 wherein an indicator light is provided indicating the pulling of the trigger and the presence of the high voltage on the electrode.

5. The system according to claim 1 wherein the ionizer unit has a ground connection.

6. The system according to claim 5 wherein the ground connection is connected to ground via a detachable wire.

7. The system according to claim 1 wherein the ionizer unit has a metal member which connects to the can when the ionizer unit is mounted to the can so that the ionizer unit and the can have a same ground potential when the system is grounded.

8. The system according to claim 7 wherein the ionizer unit has at least a portion of its housing formed of metal and wherein an extension of that housing contacts the can when the can is mounted onto the ionizer unit.

9. A method for removing particles from a surface, comprising the steps of:

providing a portable compressed gas can containing a particle removal gas;

providing an ionizer unit connected by a releasable coupling mounting the ionizer unit on the can;

providing the ionizer unit with a moveable trigger which contacts a nozzle of the can and also is connected to a high voltage electrode so as that as the trigger moves it depresses the nozzle on the can and moves the electrode in a gas stream, the electrode having high voltage thereon sufficient to create ions in the gas stream exiting from the nozzle, said gas stream being sufficient to remove particles from the surface desired to be clean; and activating said moveable trigger to create said high voltage potential when said nozzle of the gas can is depressed so that said high voltage potential is delivered by said electrode positioned in said gas stream to create said ions in the gas stream to facilitate removal of the particles.

10. The method according to claim 9 including the step of providing a high voltage potential in a range from −4 to −5 kilovolts.

11. The method according to claim 9 including the step of attaching the ionizer unit onto the compressed can at some time prior to use, the attachment of the gas can to the ionizer unit also being detachable at any time.

12. The method according to claim 9 including the step of providing a ground wire connected to the ionizer unit and connecting the ground wire to a ground during use of the ionizer unit to prevent electrical charge filled up on the unit during use.

13. The method according to claim 12 including the step of automatically providing an electrical connection between the ionizer unit and the can when the ionizer unit is connected to the can.

* * * * *